US012692808B1

(12) United States Patent
Edgar et al.

(10) Patent No.: US 12,692,808 B1
(45) Date of Patent: Jul. 28, 2026

(54) LOCOMOTIVE EXHAUST AFTERTREATMENT SYSTEM

(71) Applicant: Echeneidae Inc., Wixom, MI (US)

(72) Inventors: Bradley L. Edgar, Oakland, CA (US); Paul Gross, Wixom, MI (US); Marcos Cavallin, Royal Oak, MI (US); Timothy Savage, Canton, MI (US)

(73) Assignee: ECHENEIDAE INC., Wixom, MI (US)

( * ) Notice: Subject to any disclaimer, the term of this patent is extended or adjusted under 35 U.S.C. 154(b) by 0 days.

(21) Appl. No.: 19/174,528

(22) Filed: Apr. 9, 2025

(51) Int. Cl.

| | |
|---|---|
| ***F01N 3/18*** | (2006.01) |
| ***B61C 5/04*** | (2006.01) |
| ***B61C 7/04*** | (2006.01) |
| ***F01N 3/021*** | (2006.01) |
| ***F01N 13/08*** | (2010.01) |

(52) U.S. Cl.
CPC ..... *F01N 3/18* (2013.01); *F01N 3/021* (2013.01); *B61C 5/04* (2013.01); *B61C 7/04* (2013.01); *F01N 13/087* (2013.01); *F01N 2410/08* (2013.01); *F01N 2410/14* (2013.01); *F01N 2590/08* (2013.01); *F01N 2900/1404* (2013.01); *F01N 2900/16* (2013.01); *F01N 2900/1602* (2013.01)

(58) Field of Classification Search
CPC combination set(s) only.
See application file for complete search history.

(56) References Cited

U.S. PATENT DOCUMENTS

| | | | | |
|---|---|---|---|---|
| 2015/0013312 | A1* | 1/2015 | Gallagher | B61C 17/12 60/274 |
| 2015/0144022 | A1* | 5/2015 | Flynn | F01N 3/0231 105/62.1 |
| 2017/0152806 | A1* | 6/2017 | Mischler | F02D 41/144 |
| 2020/0095926 | A1* | 3/2020 | Sondur | B61C 17/06 |
| 2022/0355832 | A1 | 11/2022 | Bachman | |
| 2023/0175431 | A1* | 6/2023 | Klingbeil | F02D 41/0055 60/273 |
| 2023/0193840 | A1* | 6/2023 | Dillen | F02M 21/0293 123/439 |

* cited by examiner

*Primary Examiner* — Binh Q Tran
(74) *Attorney, Agent, or Firm* — Fredrikson & Byron, P.A.

(57) ABSTRACT

A system is disclosed that includes an exhaust duct assembly coupled to a locomotive producing locomotive exhaust and coupled to a capture car, the capture car housing a generator, an aftertreatment system, a mixing valve, and a controller. The mixing valve is in fluid communication with the exhaust duct assembly, the generator, the aftertreatment system, and the atmosphere. The controller is configured to receive a first signal indicative of a system condition and to cause the mixing valve to direct an output gas (locomotive exhaust and/or generator exhaust) through to the aftertreatment system and/or the atmosphere. The system condition can be a gas temperature, a backpressure condition, and/or a condition indicating whether a system component is active or inactive.

26 Claims, 9 Drawing Sheets

LOCOMOTIVE EXHAUST AFTERTREATMENT SYSTEM

FIELD

This disclosure relates to systems and methods for treating exhaust from a locomotive engine.

BACKGROUND

Locomotive engine exhaust includes various chemical species, which may be regulated by government agencies. For example, locomotive engine exhaust can include hydrocarbons (HC), oxides of nitrogen (NOx), particulate matter (PM), carbon monoxide (CO), and carbon dioxide ($CO_2$). Governmental regulations can vary, but in many jurisdictions, the locomotive engine exhaust may be emitted into the atmosphere without treatment. For example, uncontrolled locomotive engine emissions may satisfy the Environmental Protection Agency (EPA) Tier 0+ emissions standards. There are beneficial effects of removing some or all such harmful chemicals from locomotive engine exhaust before emission into the atmosphere (e.g., meeting stricter governmental regulations in specific jurisdictions, decreasing air pollution generally, facilitating capture of carbon dioxide, etc.).

SUMMARY

An aftertreatment system (ATS) may be used to treat locomotive engine exhaust. In particular, the ATS can remove some or all of the HC, NOx, PM, and CO from locomotive engine exhaust. The ATS may be located on a capture car that is separate from the locomotive, or may be located on the locomotive. The capture car can be connected mechanically to the locomotive to ensure that the capture car moves along with the locomotive. An exhaust duct assembly can transmit the locomotive engine exhaust from the locomotive to the capture car (also known as a 'tender car'). In many examples, the capture car can house a carbon capture system (CCS) that removes carbon dioxide from the locomotive engine exhaust. However, in order for the carbon capture system to effectively remove carbon dioxide from the locomotive engine exhaust, the ATS may first need to remove some or all of the HC, NOx, PM, and CO. Removal of such chemicals can reduce air pollutants associated with the exhaust while also mitigating the risk of fouling, plugging, or other unwanted interactions and/or effects on the CCS associated with the chemicals.

In some examples, the capture car includes a generator (or set of generators) that provides power to equipment housed on the capture car (e.g., the carbon capture system) so that such equipment need not rely on power from the locomotive engine. The generator is typically a diesel generator, which produces exhaust. The generator exhaust is typically subject to more strict environmental standards than the locomotive engine exhaust.

The ATS can effectively remove HC, NOx, PM, and CO from the locomotive engine exhaust when the locomotive engine exhaust enters the ATS within a specific temperature range. The ATS can include catalysts that promote various chemical reactions, as well as various filters to trap PM. However, in order for these chemical reactions to occur, the gases entering the ATS may need to be within a temperature range or above a minimum temperature. If the locomotive engine exhaust is at a temperature that falls outside of the specific range (e.g., is too low), the ATS will not effectively remove the relevant chemicals. Given the temperature of the locomotive engine exhaust as it exits the locomotive engine and its path through the exhaust duct assembly, the temperature of the locomotive engine exhaust is often too low to be processed effectively by the ATS. In such circumstances, the locomotive engine exhaust must often be emitted into the atmosphere without treatment, meaning that it includes HC, NOx, PM, and CO, and its full measure of carbon dioxide.

In some preferred examples, generator exhaust may be mixed with locomotive engine exhaust before entrance into the ATS to adjust the temperature of the gas entering the ATS. Generator exhaust is typically at a higher temperature than locomotive engine exhaust, especially after the locomotive engine exhaust has passed through the exhaust duct assembly from the locomotive to the capture car. Mixing the generator exhaust into the locomotive engine exhaust may increase the temperature of the combined gas into the effective range of the ATS. As a result, some or all of the HC, NOx, PM, and CO may be removed by the ATS, and the gas that exits the ATS may be processed by the carbon capture system, which can remove and store some or all of the carbon dioxide and emit the much cleaner gas into the atmosphere.

The systems and methods described herein may also be used to manage backpressure throughout the system to avoid adding load to the locomotive engine, or otherwise impact engine performance. The ATS and CCS may have associated backpressure limits, and backpressure may need to be mitigated during use of the system. To mitigate backpressure, exhaust may bypass the ATS and/or CCS. The locomotive exhaust, genset exhaust, or a combination of both locomotive or genset exhaust may either fully or partially bypass the ATS or CCS, which can protect system components.

One embodiment includes a system comprising an exhaust duct assembly coupled to a locomotive and to a capture car housing a generator, an aftertreatment system, a mixing valve, and a controller. The exhaust duct assembly includes an exhaust duct assembly inlet and an exhaust duct assembly outlet. The exhaust duct assembly is in fluid communication with a locomotive engine exhaust outlet of the locomotive. The locomotive is configured to produce locomotive exhaust through the locomotive engine exhaust outlet. The generator is configured to produce generator exhaust through a generator exhaust outlet. The aftertreatment system includes an aftertreatment system inlet. The mixing valve includes a first inlet in fluid communication with the exhaust duct assembly outlet, a second inlet in fluid communication with the generator exhaust outlet, a first outlet in fluid communication with the aftertreatment system inlet, and a second outlet in fluid communication with the atmosphere. The controller is configured to receive a first signal indicative of a first system condition and to cause the mixing valve to direct an output gas through the first outlet and/or the second outlet based on the first signal. The output gas includes the locomotive exhaust, the generator exhaust, or a mixture of the locomotive exhaust and the generator exhaust.

In a further embodiment of the method, the first system condition comprises a low-locomotive-exhaust-temperature condition. The controller is configured, in response to the low-locomotive-exhaust-temperature condition, to cause the mixing valve to direct all the output gas through the second outlet into the atmosphere. In this further embodiment, the low-locomotive-exhaust-temperature condition comprises a locomotive exhaust temperature value being below 200 degrees Celsius. In some embodiments, the low-locomotive-exhaust-temperature condition comprises a locomotive exhaust temperature value being below 200-250 degrees Celsius.

In a further embodiment, the first system condition comprises a low-locomotive-exhaust-temperature condition. The controller is configured, in response to the low-locomotive-exhaust-temperature condition, to cause the mixing valve to mix locomotive exhaust from the first inlet with generator exhaust from the second inlet and to direct mixed output gas through the first outlet into the aftertreatment system inlet. In this further embodiment, the controller is further configured to receive a second signal indicative of a temperature-within-range condition and, in response to the temperature-within-range condition, cause the mixing valve to continue directing the mixed output gas through the first outlet into the aftertreatment system. In this further embodiment, the mixed output gas comprises all the locomotive exhaust from the first inlet and all the generator exhaust from the second inlet.

In a further embodiment, the first system condition comprises a backpressure condition. The controller is configured, in response to the backpressure condition, to cause the mixing valve to direct at least a portion of the output gas through the second outlet into the atmosphere. In this further embodiment, the controller is configured, in response to the backpressure condition, to cause the mixing valve to direct a greater proportion of generator exhaust than of locomotive exhaust through the second outlet into the atmosphere.

In a further embodiment, the first system condition comprises an aftertreatment-system-inactive condition, and the controller is configured, in response to the aftertreatment-system-inactive condition, to cause the mixing valve to direct all the output gas through the second outlet into the atmosphere.

In a further embodiment, the first system condition comprises an aftertreatment-system-active condition. The controller is configured, in response to the aftertreatment-system-active condition, to cause the mixing valve to direct the output gas through the first outlet into the aftertreatment system inlet. The controller is configured to receive a second signal indicative of a second system condition comprising an aftertreatment-system-inactive condition. The controller is configured, in response to the aftertreatment-system-inactive condition, to cause the mixing valve to direct all the output gas through the second outlet into the atmosphere.

In a further embodiment, the generator comprises multiple generator units. The first system condition comprises a diesel-particulate-filter-regeneration condition. The controller is configured, in response to the diesel-particulate-filter-regeneration condition, to cause one of the generator units to operate at a higher load level than other generator units to produce generator exhaust that is at a higher temperature than if all the generator units were operating at the same load level, and cause the mixing valve to mix locomotive exhaust from the first inlet with generator exhaust from the second inlet and to direct mixed output gas through the first outlet into the aftertreatment system inlet.

In a further embodiment, the aftertreatment system further includes an aftertreatment system outlet. The system further comprises a carbon capture system housed by the capture car and a bypass valve. The carbon capture system includes a carbon capture gas inlet. The bypass valve has a bypass valve inlet in fluid communication with the aftertreatment system outlet, a first bypass valve outlet in fluid communication with the carbon capture gas inlet, and a second bypass valve outlet in fluid communication with the atmosphere. The controller is configured to receive a second signal indicative of a second system condition and to cause the bypass valve to direct an aftertreatment system output gas through the first bypass valve outlet and/or the second bypass valve outlet based on the second signal. In this further embodiment, the first system condition comprises a backpressure condition. The controller is configured, in response to the backpressure condition, to cause the bypass valve to direct at least a portion of the aftertreatment system output gas through the second bypass valve outlet into the atmosphere. In this further embodiment, the first system condition comprises a carbon-capture-system-inactive condition. The controller is configured, in response to the carbon-capture-system-inactive condition, to cause the bypass valve to direct the aftertreatment system output gas through the second bypass valve outlet into the atmosphere. In this further embodiment, the second system condition comprises a carbon-capture-system-active condition. The controller is configured, in response to the carbon-capture-system-active condition, to cause the bypass valve to direct the aftertreatment system output gas through the first bypass valve outlet into the carbon capture gas inlet. The controller is configured to receive a third signal indicative of a third system condition comprising a carbon-capture-system-inactive condition.

Another embodiment includes a method comprising a step of providing a locomotive exhaust treatment system. The system includes a generator having a generator exhaust outlet, an aftertreatment system including an aftertreatment system inlet, a mixing valve having a first inlet in fluid communication with a locomotive exhaust outlet of a locomotive, a second inlet in fluid communication with the generator exhaust outlet, a first outlet in fluid communication with the aftertreatment system inlet, and a second outlet, and a controller in operable communication with the mixing valve. The method further includes a step of flowing locomotive exhaust to the first inlet of the mixing valve. The method further includes a step of supplying power to the aftertreatment system and the controller from the generator, thereby causing generator exhaust to flow to the second inlet of the mixing valve. The method further includes a step of identifying a first system condition associated with the locomotive exhaust treatment system via the controller. The method further includes a step of, in response to the identified first system condition, controlling the mixing valve with the controller to do one of: direct an output gas to the aftertreatment system through the first outlet, the output gas comprising the locomotive exhaust, the generator exhaust, or a mixture of the locomotive exhaust and the generator exhaust, direct the output gas to the atmosphere through the second outlet, or direct a first portion of the output gas to the aftertreatment system through the first outlet and a second portion of the output gas to the atmosphere through the second outlet.

In a further embodiment, the first system condition comprises a low-locomotive-exhaust-temperature condition, and the step of controlling the mixing valve with the controller comprises directing the output gas to the atmosphere through the second outlet, the output gas comprising all the locomotive exhaust and all the generator exhaust.

In a further embodiment, the first system condition comprises a temperature-within-range condition, and the step of controlling the mixing valve with the controller comprises directing the output gas to the aftertreatment system through the first outlet, the output gas comprising all the locomotive exhaust and all the generator exhaust.

In a further embodiment, the first system condition comprises a backpressure condition, and the step of controlling the mixing valve with the controller comprises directing the first portion of the output gas to the aftertreatment system through the first outlet and the second portion of the output gas to the atmosphere through the second outlet. In this further embodiment, the first portion comprises a greater ratio than the second portion of locomotive exhaust to generator exhaust.

In a further embodiment, the first system condition comprises an aftertreatment-system-inactive condition, and the step of controlling the mixing valve with the controller comprises directing all the output gas to the atmosphere through the second outlet.

In a further embodiment, the first system condition comprises a diesel-particulate-filter-regeneration condition, the step of supplying power to the aftertreatment system and the controller from the generator comprises causing a first generator unit of the generator to operate at a higher load level than a second generator unit of the generator, and the step of controlling the mixing valve with the controller comprises directing the output gas to the aftertreatment system through the first outlet.

In a further embodiment, the locomotive exhaust system further comprises an exhaust duct assembly coupled to the locomotive and to a capture car, the exhaust duct assembly including an exhaust duct assembly inlet and an exhaust duct assembly outlet, the exhaust duct assembly inlet being in fluid communication with the locomotive engine exhaust outlet of the locomotive. The generator is housed by the capture car, the aftertreatment system is housed by the capture car, the mixing valve is housed by the capture car and the first inlet is in fluid communication with the exhaust duct assembly outlet, and flowing locomotive exhaust to the first inlet of the mixing valve comprises flowing locomotive exhaust through the exhaust duct assembly to the first inlet of the mixing valve.

In a further embodiment, the aftertreatment system further includes an aftertreatment system outlet. The locomotive exhaust treatment system further comprises a carbon capture system housed by a capture car, the carbon capture system including a carbon capture gas inlet. The locomotive exhaust treatment system further comprises a bypass valve housed by the capture car and having a bypass valve inlet in fluid communication with the aftertreatment system outlet, a first bypass valve outlet in fluid communication with the carbon capture gas inlet, and a second bypass valve outlet in fluid communication with the atmosphere. The method further includes a step of identifying a second system condition associated with the locomotive exhaust treatment system via the controller. The method further includes a step of in response to the identified second system condition, controlling the bypass valve with the controller to do one of: direct the aftertreatment system output gas through the first bypass valve outlet into the carbon capture gas inlet, direct the aftertreatment system output gas through the second bypass valve outlet into the atmosphere, or direct a first portion of the aftertreatment system output gas through the first bypass valve outlet into the carbon capture gas inlet and a second portion of the aftertreatment system output gas through the second bypass valve outlet into the atmosphere. In a further embodiment of this method, the first system condition comprises a backpressure condition, and the step of controlling the bypass valve with the controller comprises directing at least a portion of the aftertreatment system output gas through the second bypass valve outlet into the atmosphere. In a further embodiment of this method, the first system condition comprises a carbon-capture-system-inactive condition, and the step of controlling the bypass valve with the controller comprises directing the aftertreatment system output gas through the second bypass valve outlet into the atmosphere.

The details of one or more examples of the disclosure are set forth in the accompanying drawings and the description below. Other features, objects, and advantages of the disclosure will be apparent from the description and drawings, and from the claims.

BRIEF DESCRIPTION OF DRAWINGS

The following drawings are illustrative of particular examples of the present invention and therefore do not limit the scope of invention. The drawings are not necessarily to scale, though embodiments can include the scale illustrated, and are intended for use in conjunction with the explanations in the following detailed description wherein like reference characters denote like elements. Examples of the present invention will hereinafter be described in conjunction with the appended drawings.

DETAILED DESCRIPTION

As noted, locomotives produce exhaust gas, which can be treated to reduce the quantity of various gases and/or particulate matter associated with the exhaust gas. The conditioning and treatment of the exhaust gas can be completed to improve emissions of the locomotive (e.g., to comply with governmental regulations). In addition, the exhaust gas can be processed to reduce emission of $CO_2$. However, carbon capture systems can require the filtering and/or removal of gases and/or particulate matter such as HC, NOx, PM, and CO prior to the processing of the $CO_2$, which can improve $CO_2$ capture.

Figure 1:
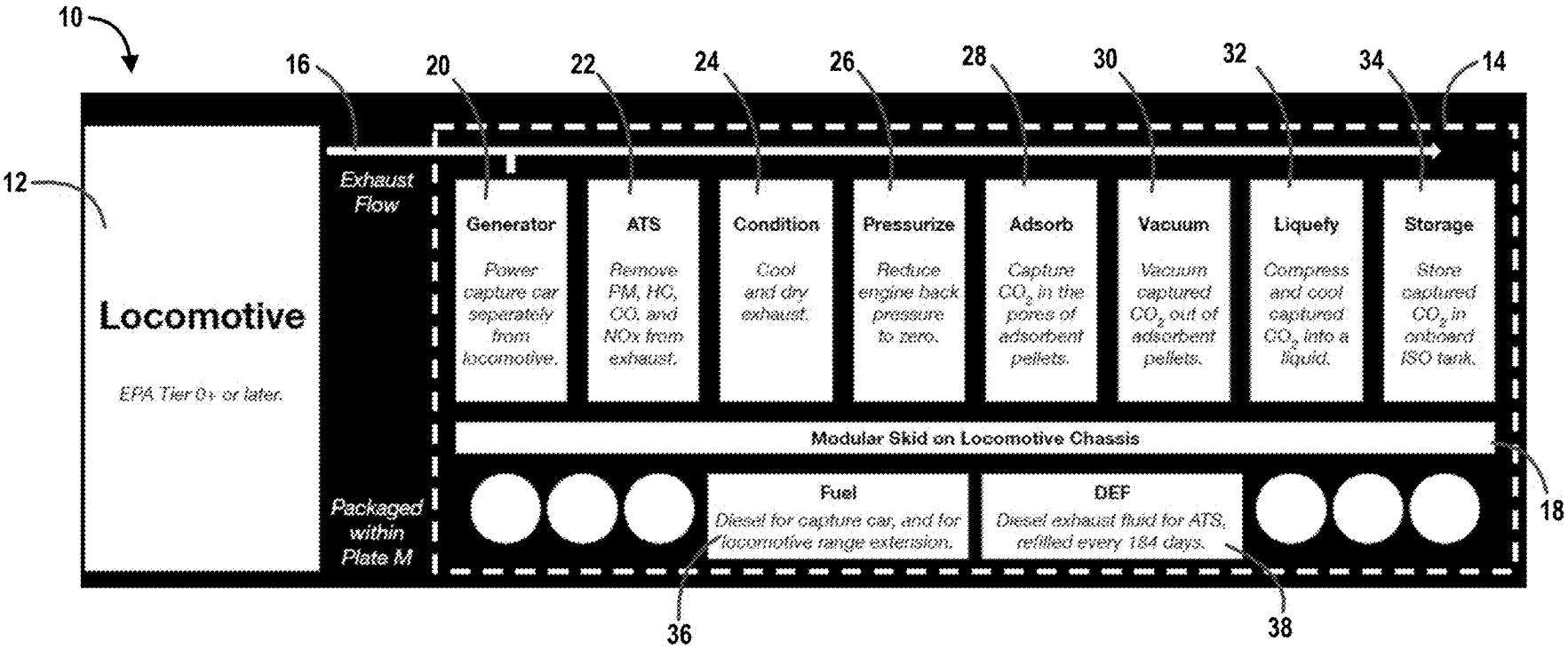
FIG. 1 is a schematic diagram of a locomotive and a capture car, in accordance with one or more examples of this disclosure.

FIG. 1 shows an illustrative railcar system 10 including a locomotive 12 and a capture car 14. The locomotive 12 can be configured to produce locomotive exhaust through a locomotive engine exhaust outlet. In some applications, the locomotive 12 can be a diesel-powered system. The locomotive 12 and capture car 14 can be in fluidic communication with one another. An exhaust duct assembly 16 can direct the flow of exhaust from the locomotive 12 to the capture car 14.

The exhaust duct assembly 16 can include an exhaust duct assembly inlet and an exhaust duct assembly outlet. The exhaust duct assembly inlet can be in fluid communication with a locomotive engine exhaust outlet of the locomotive 12. The exhaust duct assembly 16 can be made of materials and/or coatings configured to withstand high exhaust temperatures. In some applications, the hardware may be made of materials configured to withstand temperatures of about 200 degrees Celsius to about 600 degrees Celsius (e.g., stainless steel).

The locomotive exhaust can have a variety of characteristics. In some applications, the unprocessed locomotive exhaust can achieve Tier 0+ EPA locomotive emissions standards. Tier 0+ emission standards can include particulate matter requirements such as 8.0 g/bhp-hr NOx, 0.22 g/bhp-hr PM, 1.0 g/bhp-hr HC, and 5.0 g/bhp-hr CO. However, as noted, it can be desirable to further reduce the emissions of locomotives by treating and/or processing the locomotive exhaust. In other applications, the unprocessed locomotive exhaust can be at pre-Tier 0 EPA locomotive emission standards, or can achieve a tier greater than Tier 0+ EPA locomotive emissions standards.

The locomotive exhaust can have a temperature that varies depending on use of the locomotive 12. In some examples, the locomotive exhaust can range from about 100 degrees Celsius to about 430 degrees Celsius. The locomotive exhaust temperature can depend on the power load demand from the locomotive diesel. The load points, also known as notches, can be associated with the mode of operation of the locomotive 12. For example, such rates can encompass notches 1-8 and can correspond to different throttle positions. As the throttle position increases (e.g., upward from notch 1), the locomotive exhaust temperature and flow rate can increase. Locomotive exhaust temperatures greater than about 200 degrees Celsius can be sufficient for treatment of the locomotive exhaust at the ATS 22 in some instances, as is discussed in further detail below.

The temperature of the locomotive exhaust can decrease as the locomotive exhaust travels through the exhaust duct assembly 16 and the exhaust loses heat. In some applications, the locomotive exhaust temperature can decrease to below 200 degrees Celsius upon reaching the capture car 14 and ATS 22. In some instances, the temperature of the locomotive exhaust can decrease by about 85 degrees Celsius to about 225 degrees Celsius while in the exhaust duct assembly 16. It can be advantageous to adjust (e.g., increase) the temperature of the locomotive exhaust in order for the exhaust to be processed properly by the ATS 22 and other capture car components.

The capture car 14 can include various components and/or modules for treatment of the locomotive exhaust. Each of the components for exhaust treatment can be a part of a modular skid (not pictured). The modular skid can be mounted to a locomotive chassis 18. The modular skid can include a generator 20 configured to produce generator exhaust through a generator exhaust outlet, an ATS 22 including an aftertreatment system inlet and outlet, a conditioning module 24, a pressurization module 26, an adsorption module 28, a vacuum module 30, a liquification module 32, and a storage module 34, as is discussed in further detail below. The capture car 14 can house a mixing valve 21. The capture car 14 can also include fuel storage tanks 36 and diesel exhaust fluid 38, or DEF, for the ATS 22. The DEF 38 can be an aqueous urea solution. While the embodiments discussed herein disclose an ATS 22 on a capture car 14, the ATS 22 may be located elsewhere in the railcar system 10, such as, for example, on the locomotive 12 and can be used with the systems and methods described herein. In such embodiments, the ATS 22 may be connected to the capture car 14 via the exhaust duct assembly 16.

In many embodiments, the ATS operates effectively only when gas enters the ATS 22 within a specific temperature range. In some applications, the input gas must be, at a minimum, between 200-250 degrees Celsius for processing by the ATS 22. Because the temperature of the locomotive exhaust can decrease within the exhaust duct assembly 16, the locomotive exhaust temperature may be too low to be properly processed as it encounters the ATS.

The auxiliary power generator 20 of the capture car 14 can be configured to power the various capture car modules. In some examples, the capture car 14 can have multiple generators 20, also referred to herein as a "genset." The capture car 14 requires electrical power to operate the exhaust processing equipment thereon. As the capture car 14 does not rely on the locomotive engine to provide power, one or more electrical generator sets are included in the capture car 14. In some instances, the genset can have three generators 20. The generator(s) 20 can be diesel generators. These gensets can be configured to meet emissions levels in compliance with any relevant regulatory requirements, such as Tier 3 or Tier 4 emissions standards.

In many instances, diesel generator exhaust can have higher temperatures than the temperatures associated with the locomotive exhaust when the locomotive exhaust reaches the capture car 14. In some embodiments, the temperature of the diesel generator exhaust can range from about 395 degrees Celsius to about 460 degrees Celsius. Because the exhaust of the genset 20 may be at a greater temperature than the locomotive exhaust, the genset exhaust can be mixed with the locomotive exhaust to increase the exhaust temperature, which can bring the temperature of the combined gas into the operating range of the ATS 22. The genset exhaust may be greater than 400 degrees Celsius.

Figure 2:
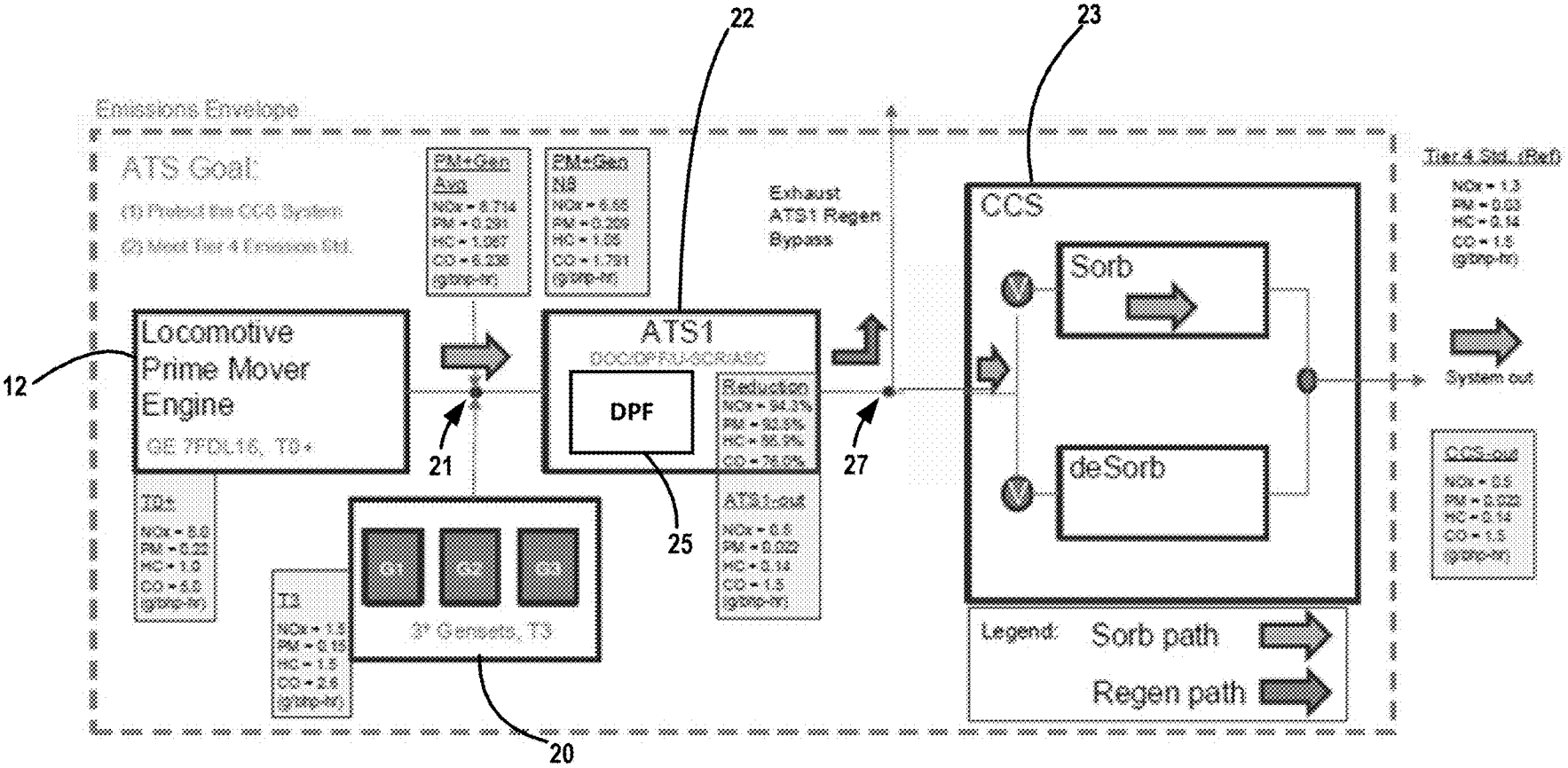
FIG. 2 is a schematic diagram of locomotive exhaust and generator exhaust being combined and passing through an ATS and a carbon capture system, in accordance with one or more examples of this disclosure.

FIG. 2 shows a schematic diagram indicating the flow of exhaust throughout the system 10 of FIG. 1. The generator 20 can be in fluidic communication with the exhaust duct assembly 16 to facilitate the mixing of exhaust. When the temperature of the locomotive exhaust is below the minimum temperature range for processing by the ATS 22, exhaust from the generator 20 can be directed into the exhaust duct assembly 16 for mixing with the locomotive exhaust. This can increase the temperature of the mixed exhaust to the range associated with processing by the ATS 22.

System information such as the temperature of the locomotive exhaust can be provided to a controller. The controller can be configured to receive a first signal indicative of a first system condition and to cause the mixing valve 21 to direct an output gas at the first outlet and/or second outlet based on the first signal. In some embodiments, the first system condition can be a low-locomotive-exhaust-temperature condition. In some applications, the low-locomotive-exhaust-temperature condition can be a locomotive exhaust temperature value below 200 degrees Celsius. The output gas can be locomotive exhaust, generator exhaust, or a combination of locomotive and generator exhaust. In some examples, the output gas can have a ratio of the locomotive exhaust to the generator exhaust. The output gas can be all of the locomotive exhaust combined with all of the generator exhaust.

The exhaust duct assembly 16 can include a variety of features. In some examples, the exhaust duct assembly 16 can include a temperature sensor (not pictured) configured to sense the temperature of the locomotive exhaust at the ATS 22. The temperature sensor can be in electrical communication with a mixing valve 21. If the sensed temperature of the locomotive exhaust is below the operating range of the ATS 22, a command can be sent to the mixing valve 21 to increase the flow of generator exhaust into the exhaust duct assembly 16 to increase the temperature of the gas entering the ATS 22. When the sensed temperature of the locomotive exhaust is within the operating range of the ATS 22 (a temperature-within-range condition), a command can be sent to the mixing valve 21 to allow no generator exhaust to flow into the exhaust duct assembly 16 and instead to emit the generator exhaust into the atmosphere.

The mixing valve 21 can direct the flow of exhaust in a variety of ways. For example, in response to a low-locomotive-exhaust-temperature condition, the controller can be configured to cause the mixing valve 21 to mix locomotive exhaust from the first inlet with generator exhaust from the second inlet and to direct mixed output gas through the first outlet into the ATS inlet. In some embodiments, the controller can be configured to receive a second signal, which can indicate a temperature-within-range condition. In response to the temperature-within-range condition, the controller can be configured to cause the mixing valve 21 to continue directing the mixed output gas through the first outlet into the ATS 22.

Some embodiments can include a plurality of temperature sensors, such as a temperature sensor configured to sense the temperature of the locomotive exhaust, a temperature sensor configured to sense the temperature of the generator exhaust, and a temperature sensor configured to sense the temperature of the combined locomotive and generator exhaust. Information from such temperature sensors can be provided to a controller, which can cause the mixing valve 21 to allow flow of locomotive exhaust and/or generator exhaust into the ATS 22 and/or to emit flow of the locomotive exhaust and/or generator exhaust into the atmosphere.

The mixing valve 21 can include a variety of features. For example, the mixing valve 21 can include a first inlet and a second inlet, as well as a first outlet and a second outlet. The first inlet can manage the flow of locomotive exhaust and the second inlet can manage the flow of genset exhaust. The first outlet can direct the flow of exhaust to the atmosphere. The second outlet can direct the flow of exhaust to the ATS.

In order to manage the functioning of the ATS 22, exhaust can bypass the ATS 22. For example, if the sensed temperature of the locomotive exhaust is below a temperature threshold (the first system condition is a low-locomotive-temperature condition) for locomotive exhaust processing by the ATS 22, the exhaust can be expelled from the exhaust duct assembly 16 such that the ATS 22 is bypassed. The controller can be configured to, in response to the low-locomotive-exhaust-temperature condition, cause the mixing valve 21 to direct all the output gas through the second outlet into the atmosphere.

Additionally or alternatively, bypass of the ATS 22 may occur depending on a system operating status. In some applications, such a bypass can occur when the locomotive 12 operates in an idle mode or in a low power mode (e.g., notch 1). For example, the first system condition can be a low-locomotive-flow-rate condition or a low-locomotive-exhaust-temperature condition and, in response to such a condition, the controller can be configured to cause the mixing valve 21 to direct all the output gas through the second outlet into the atmosphere. Additionally or alternatively, the controller can be configured to cause the mixing valve 21 to direct the output gas to the ATS 22 when the first system condition is a low-locomotive-flow-rate condition or a low-locomotive-exhaust-temperature condition. The temperature of the locomotive exhaust may naturally be too low for the ATS 22 in such condition, so the locomotive exhaust may be heated electrically. The low-locomotive-exhaust-temperature condition may be associated with a locomotive exhaust temperature of about 200 degrees Celsius or less, and the low-locomotive-flow-rate condition may be associated with an exhaust flow rate of about 2,750 kg/hour or less.

In some instances, the locomotive 12 may be operating under a dynamic-braking condition. When the locomotive 12 operates under a dynamic-braking condition, the controller can be configured to cause the mixing valve 21 to direct all the output gas through the second outlet into the atmosphere. Additionally or alternatively, the controller can be configured to cause the mixing valve 21 to direct the output gas to the ATS 22. In such instances, the output gas can be heated electrically.

In some instances, the locomotive 12 may be operating in a normal power mode (e.g., notch 2, notch 3, notch 4, notch 5, notch 6, or notch 7). In such instances, the first system condition can be a temperature-within-range condition or a flow-rate-within-range condition. In response to such a condition, the controller can be configured to cause the mixing valve 21 to mix locomotive exhaust from the first inlet with generator exhaust from the second inlet and to direct mixed output gas through the first outlet into the ATS inlet. The temperature-within-range condition may be associated with locomotive exhaust temperatures ranging from above 250 degrees Celsius to about 390 degrees Celsius, and the flow-rate-within-range condition may be associated with an exhaust flow rate ranging from about 5,500 kg/hour to about 27,000 kg/hour.

In some instances, a bypass percentage may be assigned to each throttle position. For example, when the throttle is in the notch 1 position, the controller can be configured to cause the mixing valve 21 to direct 100% of the output gas through the second outlet into the atmosphere. In such example, when the throttle is in the notch 2 position, the controller can be configured to cause the mixing valve 21 to direct 0% of the output gas through the second outlet into the atmosphere. In such example, when the throttle is in the notch 3 position, the controller can be configured to cause the mixing valve 21 to direct 5% of the output gas through the second outlet into the atmosphere. In such example, when the throttle is in the notch 4 position, the controller can be configured to cause the mixing valve 21 to direct 10% of the output gas through the second outlet into the atmosphere. In such example, when the throttle is in the notch 5 position, the controller can be configured to cause the mixing valve 21 to direct 20% of the output gas through the second outlet into the atmosphere. In such example, when the throttle is in the notch 6 position, the controller can be configured to cause the mixing valve 21 to direct 30% of the output gas through the second outlet into the atmosphere. In such example, when the throttle is in the notch 7 position, the controller can be configured to cause the mixing valve 21 to direct 40% of the output gas through the second outlet into the atmosphere. In such example, when the throttle is in the notch 8 position, the controller can be configured to cause the mixing valve 21 to direct 50% of the output gas through the second outlet into the atmosphere. In this example, the percentage of output gas not directed through the second outlet into the atmosphere is directed through the first outlet into the aftertreatment system inlet.

In some instances, the controller can be configured to cause the mixing valve 21 to direct 100% of the output gas through the first outlet into the aftertreatment system inlet, even when the locomotive exhaust temperature is naturally too low. In such instances, the locomotive exhaust may be heated electrically.

In many instances, it can be important that the components of the capture car 14 in combination with the exhaust duct assembly 16 do not create backpressure on the locomotive engine. The components of the capture car 14 should not impact operation of the locomotive engine. The components can have a maximum flow rate under which the components may operate, with components having higher maximum flow rates often being larger and expensive. In general, a blower system can control the flow through such components to stay within the maximum flow rates. However, a malfunction in the blower system, can result in a backpressure condition. The exhaust duct assembly 16 can include a pressure sensor, which can provide information to the controller. If the controller determines that a backpressure condition is present (e.g., that the backpressure exceeds a predetermined backpressure limit), the controller can cause the mixing valve 21 to bypass the ATS 22 (and CCS 23) and emit some or all of the locomotive exhaust into the atmosphere. By bypassing the ATS 22 and/or CCS 23, the flow rate of exhaust through the system can be reduced. The controller can continue such bypassing until the backpressure condition ceases and backpressure is below the backpressure limit.

In applications where the temperature of the locomotive exhaust is increased via the genset exhaust, during operation of the locomotive 12 in a normal mode, the locomotive exhaust and the genset exhaust can be fully or partially passed through the ATS 22 and CCS 23. In some applications, the genset 20 operation can be modified to provide high temperature generator exhaust. For example, in gensets 20 comprising three generators, only one generator may be run at a full load and generating a high-temperature generator exhaust, rather than three generators each running a partial load and generating a lower-temperature generator exhaust than that of one generator run at a full load. Other such adjustments to genset 20 operation may be made to produce the required exhaust temperature to allow the ATS to function properly (e.g., running the genset 20 to produce power that is not otherwise used by the system solely in order to produce exhaust).

The ATS 22 can be used to process the exhaust from the exhaust duct assembly 16. The ATS 22 can be any ATS that is configured for use in locomotive applications, such as that shown in FIG. 2. The ATS 22 can be any ATS configured to remove any or all HC, NOx, PM, and CO emissions from locomotive exhaust.

Figure 3:
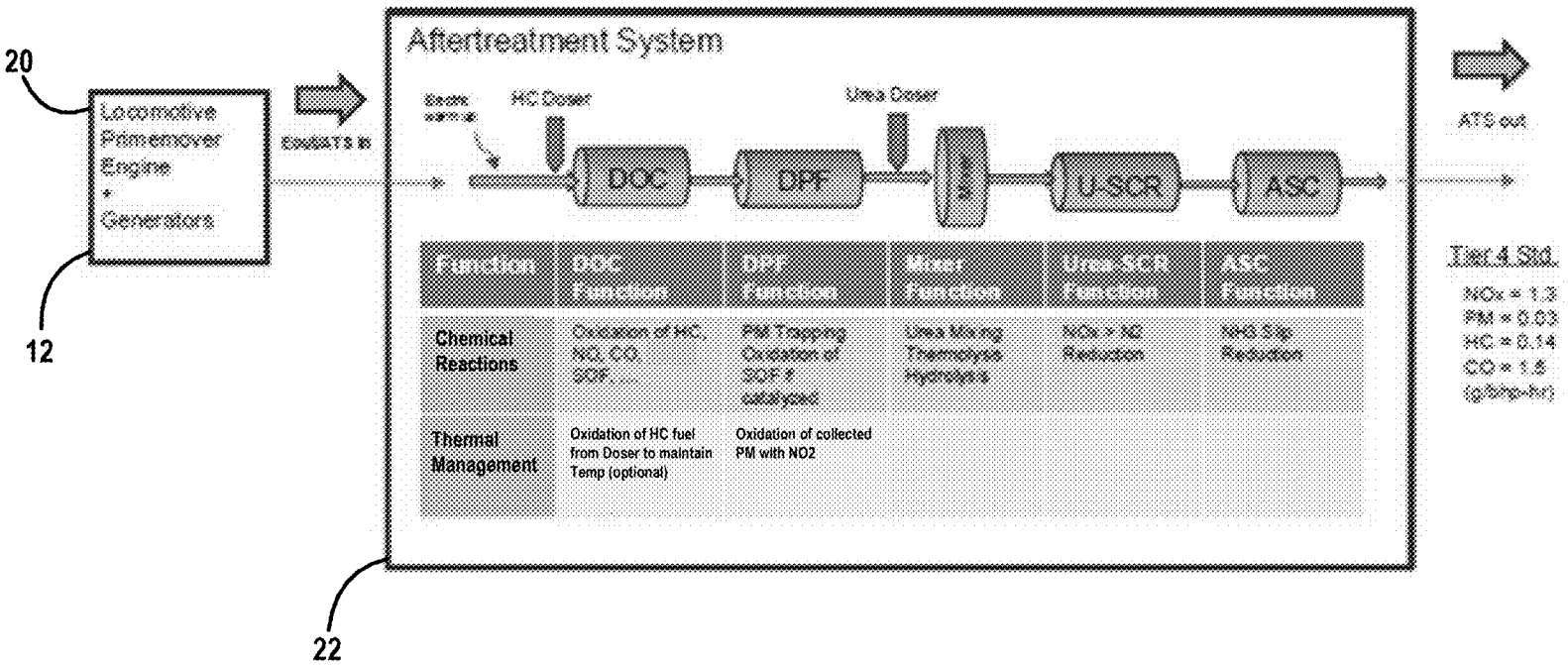
FIG. 3 is a schematic diagram of a gas stream composed of locomotive engine exhaust and generator exhaust passing through an ATS, in accordance with one or more examples of this disclosure.

FIG. 3 shows a schematic diagram including additional details of an illustrative ATS 22. Referring to both FIG. 2 and FIG. 3, the ATS 22 can include a diesel particulate filter 25, or DPF. The DPF 25 can be subject to accumulated soot generated during operation of the locomotive 12. The systems and methods described herein can reduce the particulate matter (e.g., soot) loading levels associated with the DPF 25 during use, allowing for passive regeneration of the DPF 25. Catalytic reactions associated with passive regeneration of the DPF 25 can occur when the exhaust temperature ranges from about 250 degrees Celsius to about 450 degrees Celsius. In some instances, the exhaust temperature can range from about 300 degrees Celsius to about 400 degrees Celsius. Additionally or alternatively, passive regeneration of the DPF 25 can occur when the locomotive is operating at normal or high-flow mode. This regeneration can be facilitated by use of one generator unit of the generator.

The controller can be configured to allow passive regeneration of the DPF 25. In some applications, the first system condition can be a diesel-particulate-filter-regeneration condition. In response to the condition, the controller can be configured to cause one of the generator units to operate at a higher load level than other generator units to produce generator exhaust that is at a higher temperature than if all the generator units were operating at the same load level and cause the mixing valve 21 to mix locomotive exhaust from the first inlet with generator exhaust from the second inlet and to direct mixed output gas through the first outlet into the aftertreatment system inlet.

The DPF 25 may be subject to active regeneration. Active regeneration of the DPF 25 can occur at any of idle, normal, or high-flow mode. During active regeneration, the locomotive exhaust may bypass the ATS 22, while the genset exhaust may flow through the ATS 22, or may only partially bypass the ATS 22. Genset exhaust may increase the temperature at the DPF 25, which can trigger active regeneration. Active regeneration may be facilitated by a supplemental injection of hydrocarbons, which can cause a catalytic reaction with a catalyst within the ATS 22 when oxidized. Such a catalytic reaction can increase the temperature of the DPF 25 such that active regeneration occurs.

In some instances, the DPF 25 may require additional maintenance. In instances where the DPF 25 may have a buildup of ash or have been damaged due to exposure to high temperatures, it may be beneficial to bypass the ATS 22 during locomotive operation. The mixing valve 21 may direct the flow of exhaust to bypass the ATS 22 during such instances.

The content of the locomotive exhaust can also vary as the exhaust travels through the exhaust duct assembly 16 and becomes mixed with generator exhaust. FIG. 2 displays the change in particulate matter of exhaust as the exhaust travels from the locomotive 12, to the generator 20 and ATS 22, and into the carbon capture system 23 (also referred to herein as CCS).

Use of the ATS 22 can improve the emissions associated with locomotive exhaust. For example, processing of the locomotive exhaust by the ATS 22 can allow the locomotive exhaust to meet EPA Tier 4 emission standards, with Tier 4 emission standards being characterized by 1.3 g/bhp-hr NOx, 0.03 g/bhp-hr PM, 0.14 g/bhp-hr HC, and 1.5 g/bhp-hr CO. In some applications, the particulate matter of the locomotive exhaust can comprise about 0.5 g/bhp-hr NOx, about 0.022 g/bhp-hr PM, about 0.14 g/bhp-hr HC, and/or about 1.5 g/bhp-hr CO once the locomotive exhaust has travelled through the system 10.

Additionally or alternatively, the treatment of the combined exhaust can protect the CCS 23. A bypass valve 27 can manage the flow of gas from the ATS 22 via the ATS outlet to the CCS 23 via a CCS inlet. The bypass valve 27 can include a first outlet in fluid communication with the CCS inlet and second outlet in communication with the atmosphere and can be modulated by a controller. The controller can be in communication with a pressure sensor and/or temperature sensor configured to sense the temperature and/or pressure of the gas between the ATS 22 and CCS 23. The controller can be configured to receive a second signal indicative of a second system condition and cause the bypass valve to direct the gas leaving the ATS 22 through the first and/or second bypass valve outlet(s) based on the second signal. In some instances, the temperature of the gas leaving the ATS 22 can be greater than the temperature associated with safe operating conditions of the CCS 23. It can be beneficial to bypass the CCS 23 with the flow of exhaust gas in such instances. In some instances, it may be beneficial to bypass the CCS 23 when the CCS 23 is not in operation. In a further illustrative instance, the bypass valve 27 may direct a portion of the gas, but not all of the gas, away from the CCS 23 and into the atmosphere.

The bypass valve 27 can manage the flow of gas when the ATS 22 is not housed on the capture car 14. For example, the exhaust duct assembly 16 can connect to the ATS 22 at the ATS outlet and can connect to the capture car 14 at a CCS 23 via the CCS inlet and/or the bypass valve 27. The bypass valve 27 can manage the flow of gas through the exhaust duct assembly 16 similarly to how the bypass valve 27 manages the flow of gas from the ATS 22, as described previously herein.

The controller(s) can determine whether to direct gas to the ATS 22 and/or CCS 23 based on various system operating conditions (e.g., temperature, pressure, and/or availability of system components). Depending on these conditions, a "safe" mode may be used when such conditions require at least one of the ATS 22 and CCS 23 to be offline. For example, both the ATS 22 and CCS 23 can operate while the locomotive is in idle mode, normal mode, or high-flow mode. As discussed elsewhere herein, the ATS 22 can by bypassed depending on various considerations associated with these modes. When both the ATS 22 and CCS 23 are not in operation, the locomotive 12 may be in operation and the locomotive exhaust can bypass the ATS 22. The controller can be configured to receive an ATS-inactive condition and, in response to the ATS-inactive condition, cause the mixing valve 21 to direct all the output gas through the second outlet into the atmosphere.

In other instances, the ATS 22 can be in use while the CCS 23 is offline and not in use. It can be desirable to maintain emission control strategies in such instances. In some embodiments, the first system condition can be a carbon-capture-system-inactive condition and the controller can be configured, in response to the carbon-capture-system-inactive condition, to cause the bypass valve to direct the aftertreatment system output gas through the second bypass valve outlet into the atmosphere. Additionally or alternatively, the second system condition can be a carbon-capture-system-active condition and the controller can be configured to, in response to the carbon-capture-system-active condition, cause the bypass valve to direct the aftertreatment system output gas through the first bypass valve outlet into the carbon capture gas inlet. The controller can be configured to receive a third signal indicative of a third system condition comprising a carbon-capture-system-inactive condition, and in response to the carbon-capture-system-inactive condition, cause the bypass valve to direct the aftertreatment system output gas through the second outlet into the atmosphere. The carbon-capture-system-active condition followed by the carbon-capture-system-inactive condition can occur when the carbon capture system becomes inactive while the locomotive and capture car are moving.

Similarly, the ATS 22 and/or CCS 23 can be bypassed depending on locomotive operation. For example, when the locomotive 12 is in idle mode or operating at notch 1, flow to both the ATS 22 and the CCS 23 can be bypassed. In such example, when the locomotive 12 is operating at notches 2-3, the backpressure may be below the backpressure limit, but exhaust flow can bypass both the ATS 22 and the CCS 23 because the exhaust may be at a temperature too low for processing by the ATS 22. In such example, when the locomotive 12 is operating at notches 4-6, the backpressure at the engine may be greater than the backpressure limit. In such instances, the locomotive exhaust and genset exhaust may be processed by the ATS 22 but may bypass the CCS 23. When the locomotive 12 is operating at a level that produces a high flow rate, the backpressure at the engine may be greater than the backpressure limit. Locomotive exhaust may be partially bypassed to the atmosphere and partially directed to the ATS 22. The exhaust may bypass the CCS 23 via the second bypass valve outlet and be directed into the atmosphere.

The ATS status can change during operation of the locomotive. The controller can control the flow of emissions in such instances. For example, the controller can receive an aftertreatment-system-active condition and, in response, cause the mixing valve 21 to direct the output gas through the first outlet into the aftertreatment system inlet. The controller can receive a second signal indicative of an aftertreatment-system-inactive condition and, in response, to cause the mixing valve 21 to direct all the output gas through the second outlet into the atmosphere. The aftertreatment-system-active condition followed by the aftertreatment-system-inactive condition can occur when the aftertreatment system becomes inactive while the locomotive and capture car are moving.

Turning back to FIG. 1, the modular skid can include additional components for the processing of locomotive exhaust. For example, the exhaust can be conditioned via a conditioning module 24. The conditioning process can include cooling and drying the exhaust. The system can include a pressurization module 26 configured to control the engine back pressure. $CO_2$ can be captured in adsorbent pellets via adsorption module 28. The pellets can have pores configured to capture the $CO_2$. A vacuum module 30 can be used to extract the $CO_2$ from the adsorbent pellets. The $CO_2$ can be compressed and cooled such that the $CO_2$ liquifies as it is captured via a liquification module 32. Once liquified, the $CO_2$ can be stored in a storage module 34 on the capture car 14.

Figure 4:
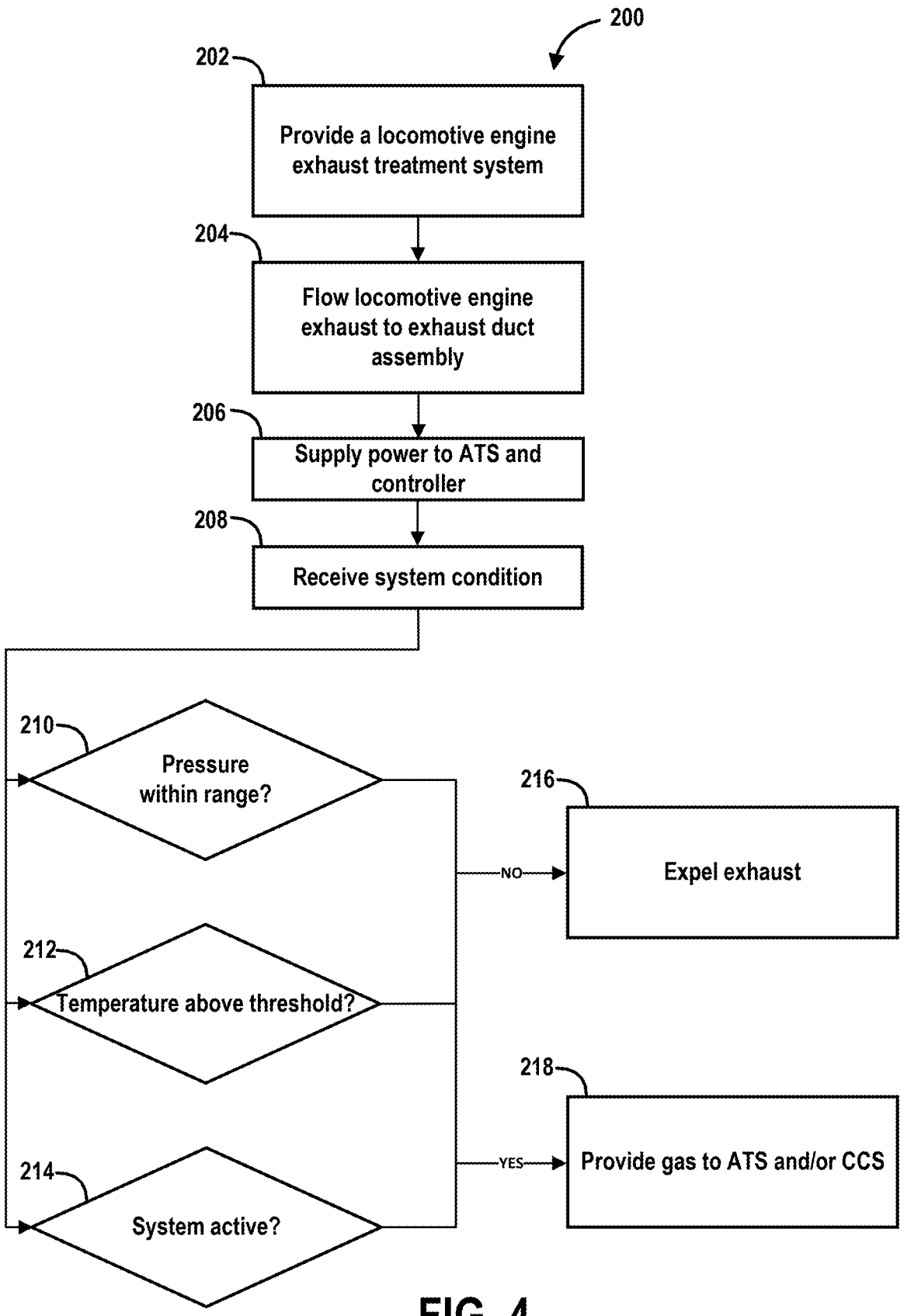
FIG. 4 is a flow diagram of an embodiment of a method of adjusting the flow of gas to a locomotive exhaust treatment system, in accordance with one or more examples of this disclosure.

FIG. 4 shows a method 200 of use of the systems described herein. The method can include providing a locomotive engine exhaust treatment system (block 202). The method 200 can include flowing locomotive exhaust through the exhaust duct assembly to the first inlet of the mixing valve (block 204) and supplying power to the aftertreatment system and the controller from the generator (block 206), thereby causing generator exhaust to flow to the second inlet of the mixing valve. The method 200 can include identifying (being informed of, actively determining, etc.) a first system condition associated with the locomotive exhaust treatment system via the controller (block 208). The condition can include identifying a pressure condition (block 210), identifying an exhaust temperature (block 212), and/or identifying a system active condition (block 214). In response to the identified first system condition, the method 200 can include controlling the mixing valve with the controller to do one of: direct an output gas to the aftertreatment system through the first outlet (block 218), direct the output gas to the atmosphere through the second outlet, or direct a first portion of the output gas to the aftertreatment system through the first outlet and a second portion of the output gas to the atmosphere through the second outlet (block 216). As will be discussed elsewhere herein, the first system condition can be a temperature condition, a backpressure condition, or a system status (e.g., system active/online, system inactive/offline) condition.

Figure 5:
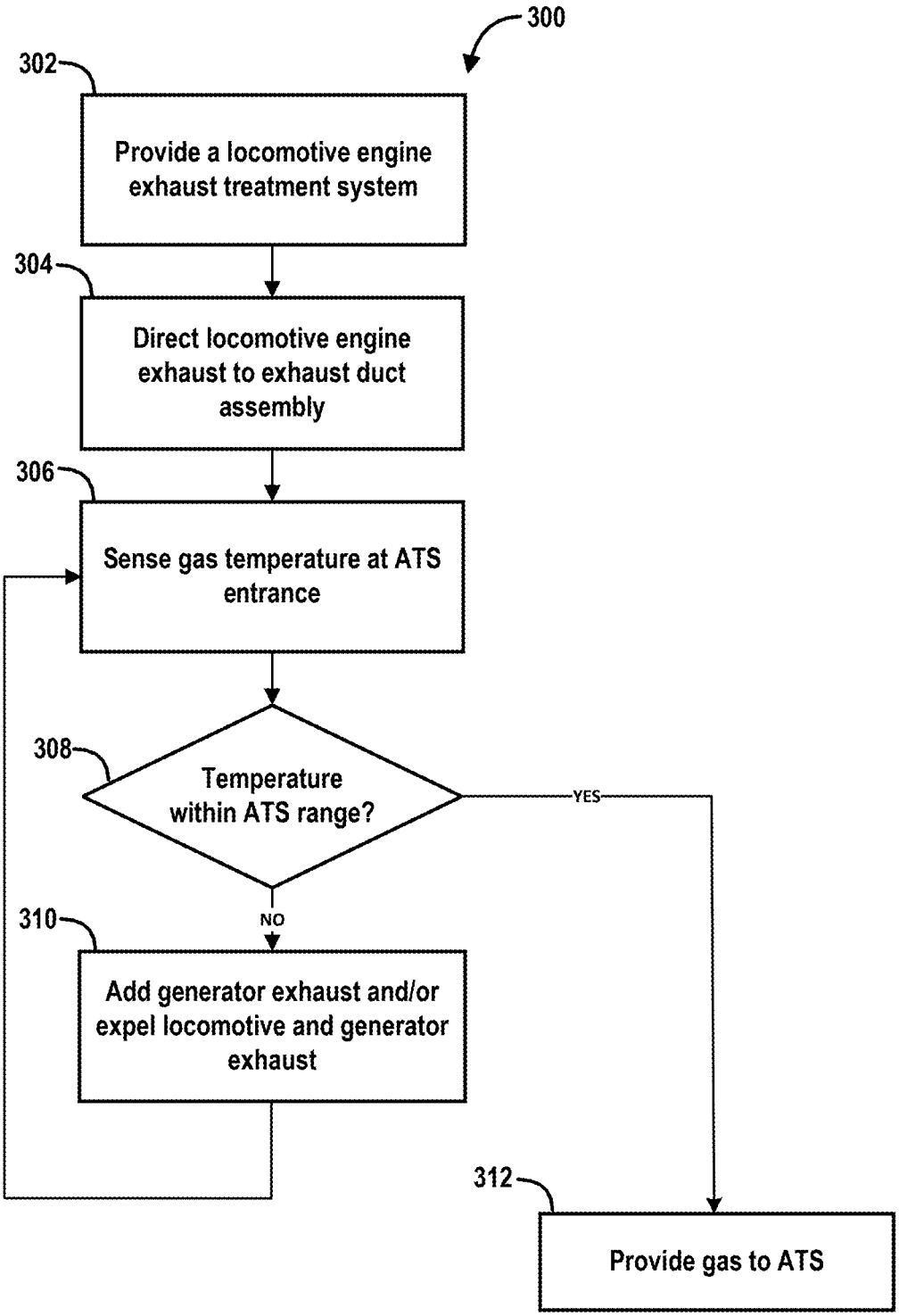
FIG. 5 is a flow diagram of an embodiment of a method of adjusting the temperature of gas entering an ATS, in accordance with one or more examples of this disclosure

FIG. 5 shows a method 300 of regulating the temperature of locomotive exhaust used in accordance with the systems and embodiments herein. The method 300 can include providing a locomotive exhaust treatment system (block 302). In some embodiments, the system can be system 10 of FIG. 1. The method 300 can include directing locomotive exhaust to the exhaust duct assembly (block 304). The method 300 can include sensing locomotive exhaust temperature of the system (block 306). If the gas temperature is within a range associated with the ATS (block 308), the gas can be provided to the ATS (block 312). In response to the sensed locomotive exhaust temperature being outside the ATS range (e.g., below a predetermined threshold and/or being a low-locomotive-exhaust-temperature condition), the method 300 can include directing generator exhaust into the exhaust duct assembly when the sensed temperature is outside the range for processing by the ATS (block 310). Additionally, or alternatively, the method 300 can include controlling the mixing valve with the controller to direct the output gas to the atmosphere through the second outlet, the output gas including all the locomotive exhaust and all the generator exhaust. Temperature sensing (block 306) can continue, and gas can be provided to the ATS (block 310) when the determination is made that the temperature is within the ATS range (block 308). The method 300 can include controlling the mixing valve with the controller to direct the output gas to the aftertreatment system through the first outlet, the output gas including all the locomotive exhaust and all the generator exhaust.

Figure 6:
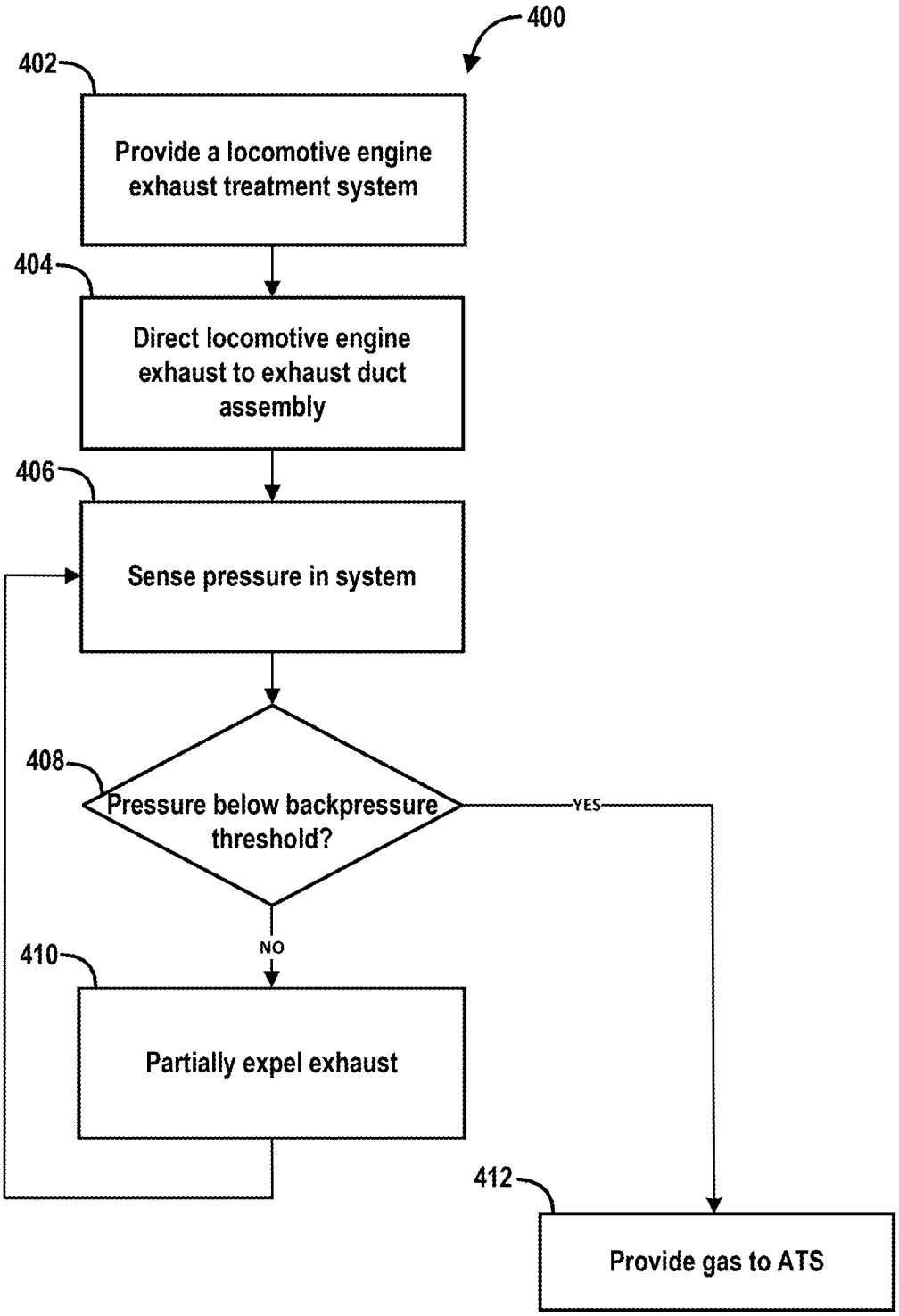
FIG. 6 is a flow diagram of an embodiment of a method of adjusting backpressure of gas entering an ATS, in accordance with one or more examples of this disclosure.

FIG. 6 shows a method 400 of directing locomotive exhaust used in accordance with the system and embodiments herein. The method 400 can include providing a locomotive exhaust treatment system (block 402), such as the illustrative system 10 of FIG. 1. The method 400 can include directing locomotive exhaust to the exhaust duct assembly (block 404) and sensing a backpressure condition associated with the system (block 406). When the condition is a system backpressure condition, controlling the mixing valve with the controller can include directing the first portion of the output gas to the aftertreatment system through the first outlet and the second portion of the output gas to the atmosphere through the second outlet (block 410). The ratio of locomotive exhaust to generator exhaust can be greater in the first portion of the output gas than the second portion of the output gas.

Figure 7:
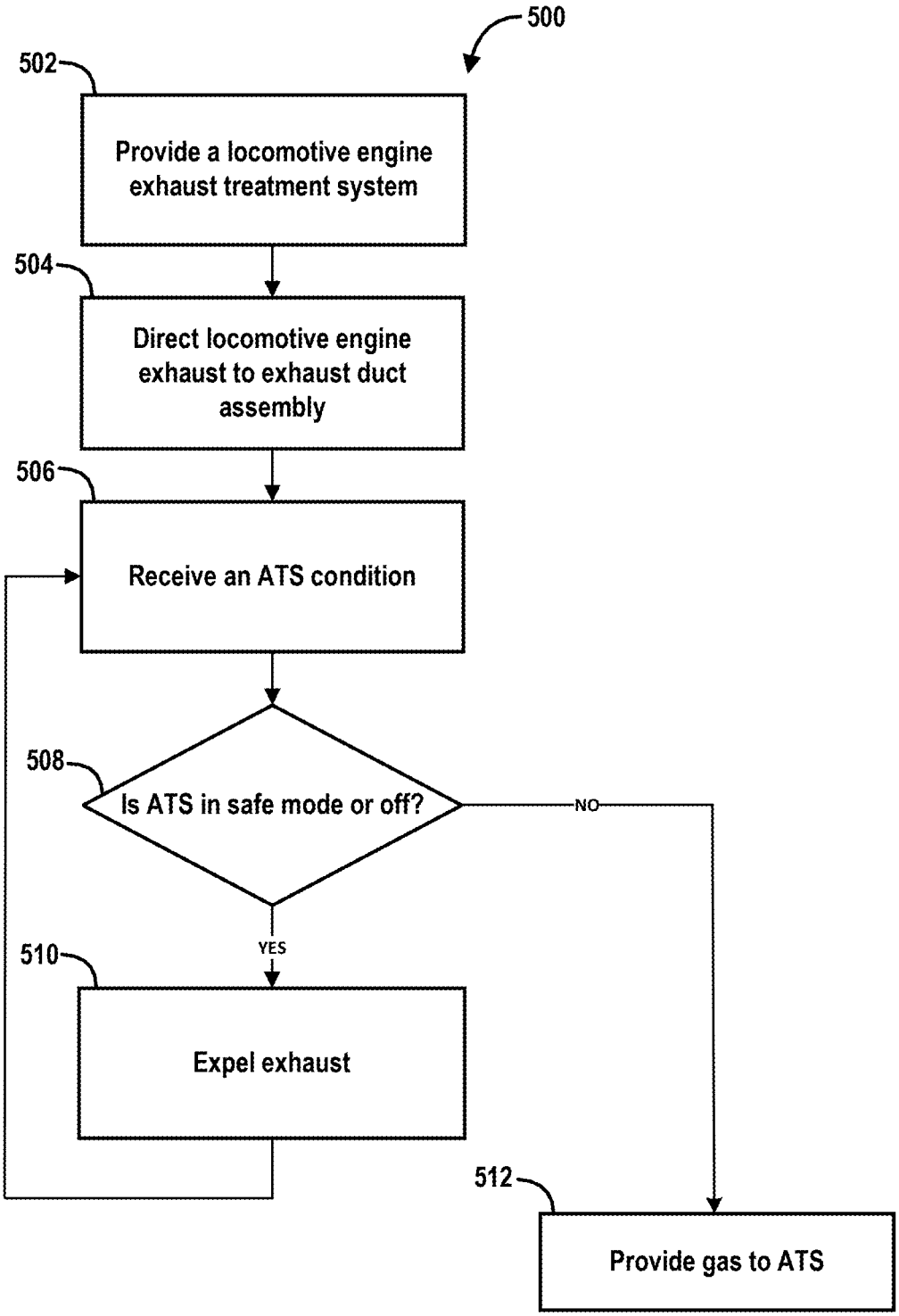
FIG. 7 is a flow diagram of an embodiment of a method of adjusting the flow of gas entering an ATS, in accordance with one or more examples of this disclosure.

FIG. 7 shows a method 500 of directing locomotive exhaust used in accordance with the system and embodiments herein. The method 500 can include providing a locomotive exhaust treatment system (block 502), such as the illustrative system 10 of FIG. 1. The method 500 can include directing locomotive exhaust to the exhaust duct assembly (block 504) and receiving an ATS condition (block 506). When the condition is an aftertreatment-system-inactive condition, controlling the mixing valve with the controller can include directing all the output gas to the atmosphere through the second outlet (block 510). If the condition is an aftertreatment-system-active condition, controlling the mixing valve with the controller can include directing all the output gas to the ATS through the first outlet (block 512).

Figure 8:
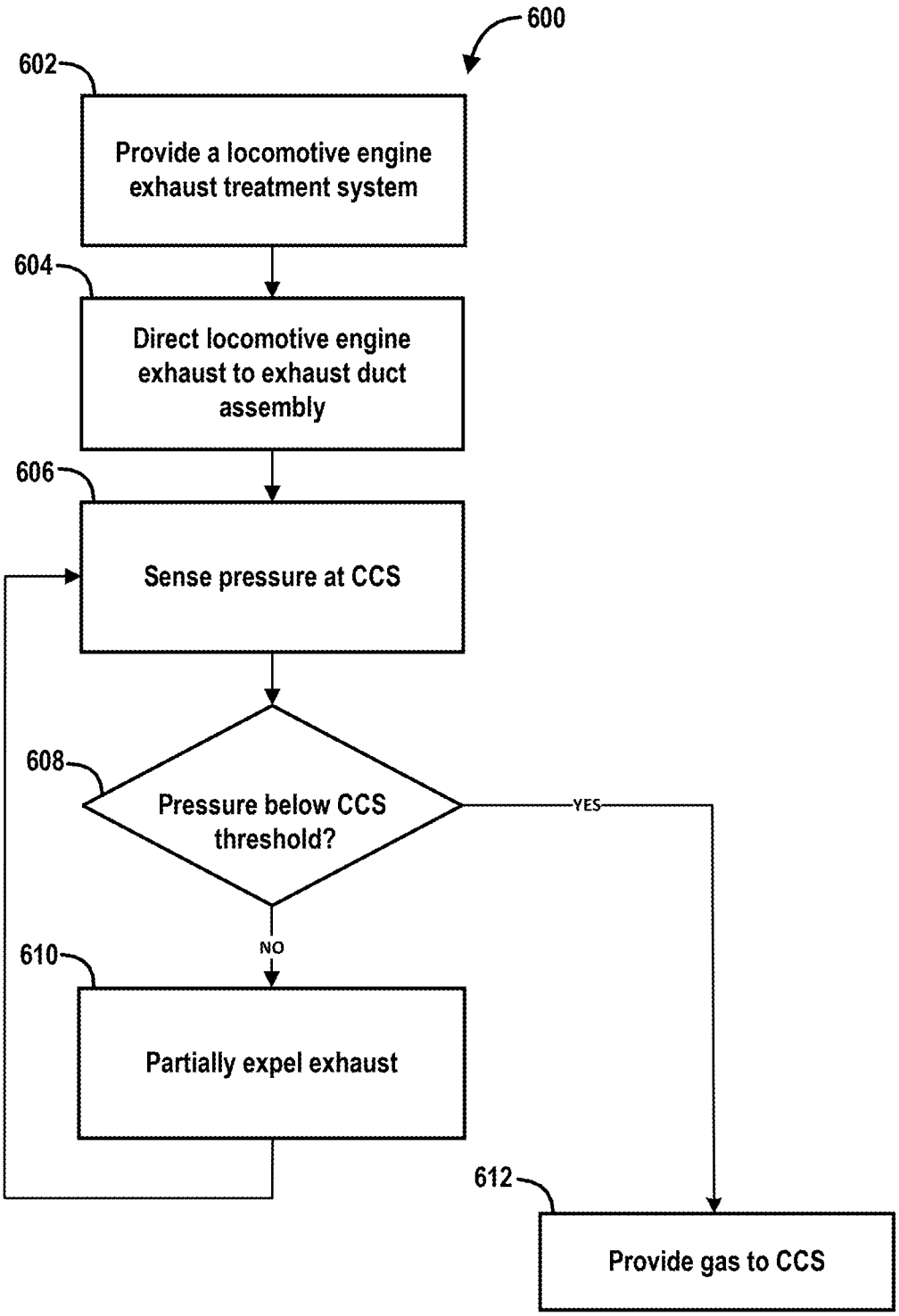
FIG. 8 is a flow diagram of an embodiment of a method of adjusting backpressure of gas entering a CCS, in accordance with one or more examples of this disclosure.

FIG. 8 shows a method 600 wherein the system includes a CCS and bypass valve, such as the illustrative CCS and bypass valve described in FIG. 2. The bypass valve can be in fluid communication with an ATS outlet. Similar to other illustrative methods described elsewhere herein, the method 600 can include providing a locomotive engine exhaust treatment system (block 602) and directing locomotive engine exhaust to the exhaust duct assembly (block 604). The method 600 can include identifying a system condition associated with the locomotive exhaust treatment system via the controller. In response to the identified condition, the method 600 can include controlling the bypass valve with the controller to do one of: direct the aftertreatment system output gas through the first bypass valve outlet into the carbon capture gas inlet, direct the aftertreatment system output gas through the second bypass valve outlet into the atmosphere, or direct a first portion of the aftertreatment system output gas through the first bypass valve outlet into the carbon capture gas inlet and a second portion of the aftertreatment system output gas through the second bypass valve outlet into the atmosphere.

In some instances of the method, the method can include sensing the presence of a backpressure condition at the CCS (block 606). The first system condition can be a backpressure condition. In response to the sensed backpressure being below a backpressure threshold associated with the CCS (block 608), the gas may be directed to the CCS (block 612). When the sensed backpressure is not within the associated threshold, at least a portion of the exhaust may be expelled using a bypass valve (block 610), as discussed elsewhere herein. The methods described herein can be used in instances wherein at least one of the ATS and CCS are not in operation.

Figure 9:
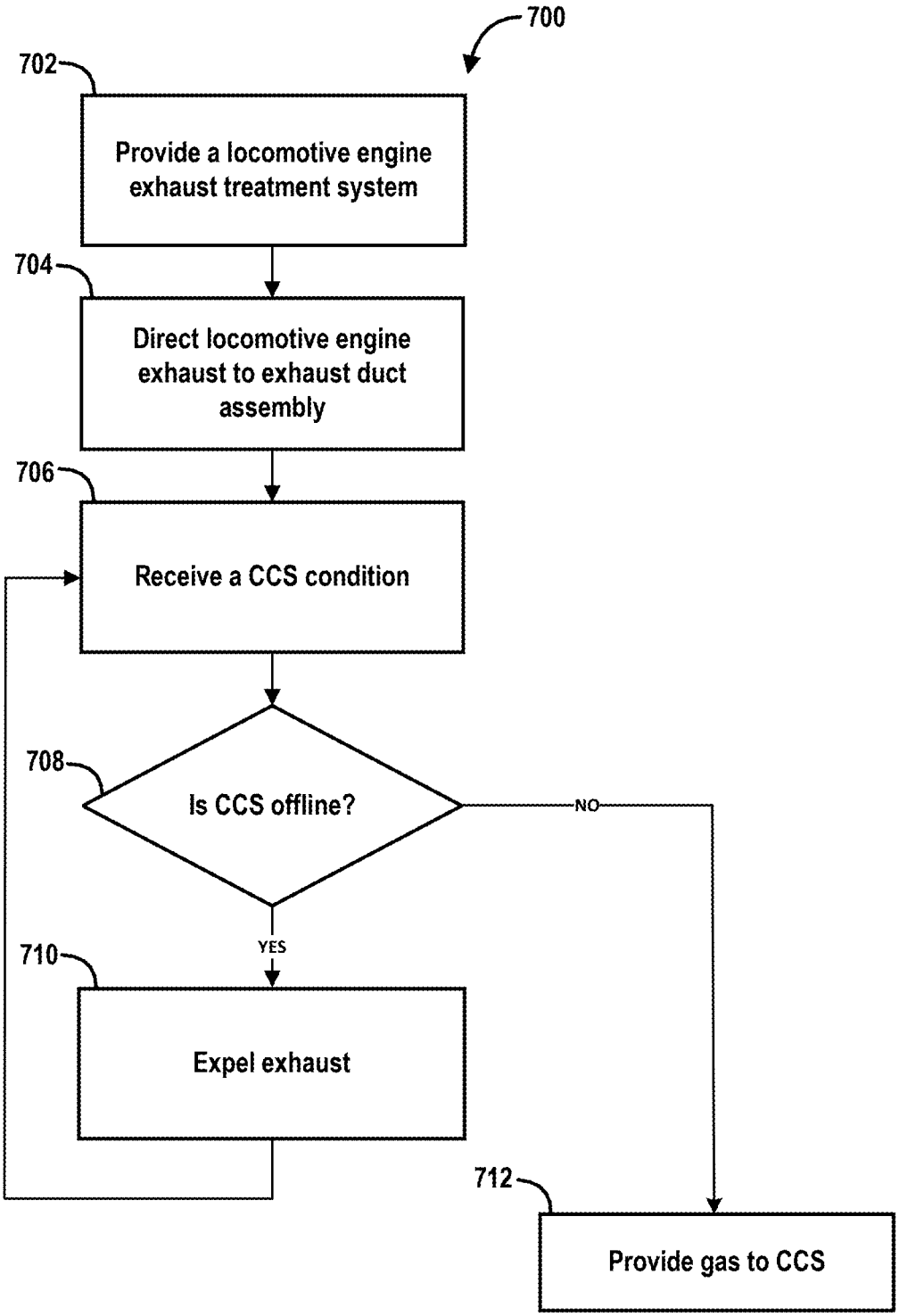
FIG. 9 is a flow diagram of an embodiment of a method of adjusting the flow of gas entering a CCS, in accordance with one or more examples of this disclosure.

FIG. 9 shows a method 700 wherein the CCS may not be active. Similar to other illustrative methods described elsewhere herein, the method 700 can include providing a locomotive engine exhaust treatment system (block 702) and directing locomotive engine exhaust to the exhaust duct assembly (block 704). The method 700 can include receiving a system condition (block 706). In such illustrative embodiments, the received system condition can be a carbon-capture-system-inactive condition (block 708), and controlling the bypass valve with the controller comprises directing the aftertreatment system output gas through the second bypass valve outlet into the atmosphere (block 710). In other applications, the first system condition can be a carbon-capture-active condition, and controlling the bypass valve with the controller comprises directing the aftertreatment system output gas through the first bypass valve outlet into the CCS (block 712).

To facilitate an understanding of the subject matter described herein, many aspects are described in terms of sequences of actions. The description herein of any sequence of actions is not intended to imply that the specific order described for performing that sequence must be followed. All methods described herein may be performed in any suitable order unless otherwise indicated herein or otherwise clearly contradicted by context.

The use of the terms "a" and "an" and "the" and similar references in the context of describing the subject matter are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. Furthermore, the foregoing description is for the purpose of illustration only, and not for the purpose of limitation, as the scope of protection sought is defined by the application. The use of any and all examples, or exemplary language (e.g., "such as") provided herein, is intended merely to better illustrate the subject matter and does not pose a limitation on the scope of the subject matter. The use of the term "based on" and other like phrases indicating a condition for bringing about a result, both in any claims and in the written description, is not intended to foreclose any other conditions that bring about that result. No language in the specification should be construed as indicating any non-claimed element as essential to the practice any claimed inventions.

While specific examples have been provided above, it is understood that the present invention can be applied with a wide variety of inputs, thresholds, ranges, and other factors, depending on the application. For example, the time frames and ranges provided above are illustrative, but one of ordinary skill in the art would understand that these time frames and ranges may be varied or even be dynamic and variable, depending on the implementation.

As those skilled in the art will understand, a number of variations may be made in the disclosed embodiments, all without departing from the scope of this disclosure. It should be noted that although the features and elements are described in particular combinations, each feature or element can be used alone without other features and elements or in various combinations with or without other features and elements. The methods or flow charts provided may be implemented in a computer program, software, or firmware tangibly embodied in a computer-readable storage medium for execution by a general-purpose computer or processor.

Thus, embodiments of a locomotive exhaust treatment system are disclosed. Although the present invention has been described in considerable detail with reference to certain disclosed embodiments, the disclosed embodiments are presented for purposes of illustration and not limitation and other embodiments of the invention are possible. One skilled in the art will appreciate that various changes, adaptations, and modifications may be made without departing from the spirit of the invention.

What is claimed is:

1. A system comprising:

an exhaust duct assembly coupled to a locomotive and to a capture car, the exhaust duct assembly including an exhaust duct assembly inlet and an exhaust duct assembly outlet, the exhaust duct assembly inlet being in fluid communication with a locomotive engine exhaust outlet of the locomotive, the locomotive being configured to produce locomotive exhaust through the locomotive engine exhaust outlet;

a generator housed by the capture car, the generator being configured to produce generator exhaust through a generator exhaust outlet;

an aftertreatment system housed by the capture car, the aftertreatment system including an aftertreatment system inlet;

a mixing valve housed by the capture car and having a first inlet in fluid communication with the exhaust duct assembly outlet, a second inlet in fluid communication with the generator exhaust outlet, a first outlet in fluid communication with the aftertreatment system inlet, and a second outlet in fluid communication with the atmosphere; and a controller configured to receive a first signal indicative of a first system condition and to cause the mixing valve to direct an output gas through the first outlet and/or the second outlet based on the first signal, the output gas comprising the locomotive exhaust, the generator exhaust, or a mixture of the locomotive exhaust and the generator exhaust.

2. The system of claim 1, wherein:

the first system condition comprises a low-locomotive-exhaust-temperature condition, and the controller is configured, in response to the low-locomotive-exhaust-temperature condition, to cause the mixing valve to direct all the output gas through the second outlet into the atmosphere.

3. The system of claim 2, wherein the low-locomotive-exhaust-temperature condition comprises a locomotive exhaust temperature value being below 200 degrees Celsius.

4. The system of claim 1, wherein:

the first system condition comprises a low-locomotive-exhaust-temperature condition, and the controller is configured, in response to the low-locomotive-exhaust-temperature condition, to cause the mixing valve to mix locomotive exhaust from the first inlet with generator exhaust from the second inlet and to direct mixed output gas through the first outlet into the aftertreatment system inlet.

5. The system of claim 4, wherein the controller is further configured to:

receive a second signal indicative of a temperature-within-range condition, and in response to the temperature-within-range condition, cause the mixing valve to continue directing the mixed output gas through the first outlet into the aftertreatment system.

6. The system of claim 4, wherein the mixed output gas comprises all the locomotive exhaust from the first inlet and all the generator exhaust from the second inlet.

7. The system of claim 1, wherein:

the first system condition comprises a backpressure condition, and the controller is configured, in response to the backpressure condition, to cause the mixing valve to direct at least a portion of the output gas through the second outlet into the atmosphere.

8. The system of claim 7, wherein the controller is configured, in response to the backpressure condition, to cause the mixing valve to direct a greater proportion of generator exhaust than of locomotive exhaust through the second outlet into the atmosphere.

9. The system of claim 1, wherein:

the first system condition comprises an aftertreatment-system-inactive condition, and the controller is configured, in response to the aftertreatment-system-inactive condition, to cause the mixing valve to direct all the output gas through the second outlet into the atmosphere.

10. The system of claim 1, wherein:

the first system condition comprises an aftertreatment-system-active condition, and the controller is configured, in response to the aftertreatment-system-active condition, to cause the mixing valve to direct the output gas through the first outlet into the aftertreatment system inlet, the controller is configured to receive a second signal indicative of a second system condition comprising an aftertreatment-system-inactive condition, and the controller is configured, in response to the aftertreatment-system-inactive condition, to cause the mixing valve to direct all the output gas through the second outlet into the atmosphere.

11. The system of claim 1, wherein:

the generator comprises multiple generator units, the first system condition comprises a diesel-particulate-filter-regeneration condition, and the controller is configured, in response to the diesel-particulate-filter-regeneration condition, to:

cause one of the generator units to operate at a higher load level than other generator units to produce generator exhaust that is at a higher temperature than if all the generator units were operating at the same load level, and cause the mixing valve to mix locomotive exhaust from the first inlet with generator exhaust from the second inlet and to direct mixed output gas through the first outlet into the aftertreatment system inlet.

12. The system of claim 1, wherein the aftertreatment system further includes an aftertreatment system outlet; and the system further comprises:

a carbon capture system housed by the capture car, the carbon capture system including a carbon capture gas inlet, and a bypass valve housed by the capture car and having a bypass valve inlet in fluid communication with the aftertreatment system outlet, a first bypass valve outlet in fluid communication with the carbon capture gas inlet, and a second bypass valve outlet in fluid communication with the atmosphere, wherein the controller is configured to receive a second signal indicative of a second system condition and to cause the bypass valve to direct an aftertreatment system output gas through the first bypass valve outlet and/or the second bypass valve outlet based on the second signal.

13. The system of claim 12, wherein:

the first system condition comprises a backpressure condition, and the controller is configured, in response to the backpressure condition, to cause the bypass valve to direct at least a portion of the aftertreatment system output gas through the second bypass valve outlet into the atmosphere.

14. The system of claim 12, wherein:

the first system condition comprises a carbon-capture-system-inactive condition, and the controller is configured, in response to the carbon-capture-system-inactive condition, to cause the bypass valve to direct the aftertreatment system output gas through the second bypass valve outlet into the atmosphere.

15. The system of claim 12, wherein:

the second system condition comprises a carbon-capture-system-active condition, the controller is configured, in response to the carbon-capture-system-active condition, to cause the bypass valve to direct the aftertreatment system output gas through the first bypass valve outlet into the carbon capture gas inlet, the controller is configured to receive a third signal indicative of a third system condition comprising a carbon-capture-system-inactive condition, and the controller is configured, in response to the carbon-capture-system-inactive condition, to cause the bypass valve to direct the aftertreatment system output gas through the second outlet into the atmosphere.

16. A method comprising:

providing a locomotive exhaust treatment system, comprising:

a generator having a generator exhaust outlet;

an aftertreatment system including an aftertreatment system inlet, a mixing valve having a first inlet in fluid communication with a locomotive exhaust outlet of a locomotive, a second inlet in fluid communication with the generator exhaust outlet, a first outlet in fluid communication with the aftertreatment system inlet, and a second outlet, and a controller in operable communication with the mixing valve;

flowing locomotive exhaust to the first inlet of the mixing valve;

supplying power to the aftertreatment system and the controller from the generator, thereby causing generator exhaust to flow to the second inlet of the mixing valve;

identifying a first system condition associated with the locomotive exhaust treatment system via the controller; and in response to the identified first system condition, controlling the mixing valve with the controller to do one of:

direct an output gas to the aftertreatment system through the first outlet, the output gas comprising the locomotive exhaust, the generator exhaust, or a mixture of the locomotive exhaust and the generator exhaust, direct the output gas to the atmosphere through the second outlet, or direct a first portion of the output gas to the aftertreatment system through the first outlet and a second portion of the output gas to the atmosphere through the second outlet.

17. The method of claim 16, wherein:

the first system condition comprises a low-locomotive-exhaust-temperature condition, and controlling the mixing valve with the controller comprises directing the output gas to the atmosphere through the second outlet, the output gas comprising all the locomotive exhaust and all the generator exhaust.

18. The method of claim 16, wherein:

the first system condition comprises a temperature-within-range condition, and controlling the mixing valve with the controller comprises directing the output gas to the aftertreatment system through the first outlet, the output gas comprising all the locomotive exhaust and all the generator exhaust.

19. The method of claim 16, wherein:

the first system condition comprises a backpressure condition, and controlling the mixing valve with the controller comprises directing the first portion of the output gas to the aftertreatment system through the first outlet and the second portion of the output gas to the atmosphere through the second outlet.

20. The method of claim 19, wherein the first portion comprises a greater ratio than the second portion of locomotive exhaust to generator exhaust.

21. The method of claim 16, wherein:

the first system condition comprises an aftertreatment-system-inactive condition, and controlling the mixing valve with the controller comprises directing all the output gas to the atmosphere through the second outlet.

22. The method of claim 16, wherein:

the first system condition comprises a diesel-particulate-filter-regeneration condition, supplying power to the aftertreatment system and the controller from the generator comprises causing a first generator unit of the generator to operate at a higher load level than a second generator unit of the generator, and controlling the mixing valve with the controller comprises directing the output gas to the aftertreatment system through the first outlet.

23. The method of claim 16, wherein:

the locomotive exhaust treatment system further comprises an exhaust duct assembly coupled to the locomotive and to a capture car, the exhaust duct assembly including an exhaust duct assembly inlet and an exhaust duct assembly outlet, the exhaust duct assembly inlet being in fluid communication with the locomotive engine exhaust outlet of the locomotive, the generator is housed by the capture car, the aftertreatment system is housed by the capture car, the mixing valve is housed by the capture car and the first inlet is in fluid communication with the exhaust duct assembly outlet, and flowing locomotive exhaust to the first inlet of the mixing valve comprises flowing locomotive exhaust through the exhaust duct assembly to the first inlet of the mixing valve.

24. The method of claim 16, wherein:

the aftertreatment system further includes an aftertreatment system outlet, the locomotive exhaust treatment system further comprises:

a carbon capture system housed by a capture car, the carbon capture system including a carbon capture gas inlet, and a bypass valve housed by the capture car and having a bypass valve inlet in fluid communication with the aftertreatment system outlet, a first bypass valve outlet in fluid communication with the carbon capture gas inlet, and a second bypass valve outlet in fluid communication with the atmosphere, and the method further comprises:

identifying a second system condition associated with the locomotive exhaust treatment system via the controller; and in response to the identified second system condition, controlling the bypass valve with the controller to do one of:

direct an aftertreatment system output gas through the first bypass valve outlet into the carbon capture gas inlet, direct the aftertreatment system output gas through the second bypass valve outlet into the atmosphere, or direct a first portion of the aftertreatment system output gas through the first bypass valve outlet into the carbon capture gas inlet and a second portion of the aftertreatment system output gas through the second bypass valve outlet into the atmosphere.

25. The method of claim 24, wherein:

the first system condition comprises a backpressure condition, and controlling the bypass valve with the controller comprises directing at least a portion of the aftertreatment system output gas through the second bypass valve outlet into the atmosphere.

26. The method of claim 24, wherein:

the first system condition comprises a carbon-capture-system-inactive condition, and controlling the bypass valve with the controller comprises directing the aftertreatment system output gas through the second bypass valve outlet into the atmosphere.

* * * * *